US007313342B2

(12) United States Patent
Katayama et al.

(10) Patent No.: US 7,313,342 B2
(45) Date of Patent: Dec. 25, 2007

(54) IMAGE FORMING APPARATUS INCLUDING CATALYST AND ACTIVE CARBON FILTERS

(75) Inventors: Hiromasa Katayama, Toride (JP); Takashi Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 11/143,706

(22) Filed: Jun. 3, 2005

(65) Prior Publication Data

US 2005/0271414 A1 Dec. 8, 2005

(30) Foreign Application Priority Data

Jun. 4, 2004 (JP) ..... 2004-166674
May 30, 2005 (JP) ..... 2005-156808

(51) Int. Cl.
*G03G 21/20* (2006.01)

(52) U.S. Cl. ..... 399/93

(58) Field of Classification Search ..... 399/91, 399/92, 93, 98, 100; 422/171, 177, 181
See application file for complete search history.

(56) References Cited

U.S. PATENT DOCUMENTS 3,890,721 A 6/1975 Katayama et al. ..... 34/73
3,997,977 A 12/1976 Katayama et al. ..... 34/73
4,143,118 A * 3/1979 Laing ..... 423/219
2004/0047646 A1 3/2004 Yon et al. ..... 399/93

FOREIGN PATENT DOCUMENTS

JP 2-273764 11/1990
JP 2004-45573 2/2004

OTHER PUBLICATIONS

Patent Abstracts of Japan, Publication No. 02273764, Nov. 8, 1990.
Patent Abstracts of Japan, Publication No. 2004045573, Feb. 12, 2004.

* cited by examiner

*Primary Examiner*—Hoang Ngo
(74) *Attorney, Agent, or Firm*—Fitzpatrick, Cella, Harper & Scinto

(57) ABSTRACT

An image forming apparatus for forming an image on a recording material includes an image bearing member; a charging device for charging the image bearing member; an air path portion for guiding both ozone produced by charging the image bearing member and volatile organic compounds produced in the image forming apparatus toward the outside atmosphere; a catalyst filter provided in the air path portion; and an activated carbon filter provided in the air path portion. The catalyst filter and the activated carbon filter are disposed in the air path portion in series. The catalyst filter is disposed upstream of the activated carbon filter with respect to a direction of flow in the air path portion.

6 Claims, 3 Drawing Sheets

IMAGE FORMING APPARATUS INCLUDING CATALYST AND ACTIVE CARBON FILTERS

FIELD OF THE INVENTION AND RELATED ART

The present invention relates to a monochromatic or full-color image forming apparatus such as a printer, a copying machine, a facsimile machine, etc., which employs an electrophotographic image forming method.

In recent years, even in the field of an electrophotographic image forming apparatus, it has become possible to form a highly glossy image by forming the image on a piece of coated paper, that is, the paper the surface of which is coated for glossiness, or to form an image on a piece of matte paper. Thus, the demand for coated paper has been increasing even in the field of a copying machine, a printer, etc.

When using coated paper as the recording medium for a copying machine, a toner image must be thermally fixed to the coated paper. However, heating coated paper at a high temperature sometimes causes the coated paper to release volatile organic components (which hereinafter will be referred to as VOCs) such as chloroethylene. As for the means for reducing the amount by which the VOCs released from the coated paper within an image forming apparatus is exhausted from the image forming apparatus, it has been a common practice to outfit the image forming apparatus with a filter which removes the VOCs by decomposing the VOCs, and this practice has been successful to reduce the amount by which the VOCs are exhausted. The filter for removing the VOCs is placed in a part of the passage through which the internal heat of the image forming apparatus is exhausted.

In recent years, the frequency with which coated paper is used as the recording medium for an electrophotographic image forming apparatus to form an electrophotographic image of high quality has been increasing even in the field of a copying machine. Thus, it has become important to further reduce the amount by which VOCs are exhausted from an electrophotographic image forming apparatus. As for the means for improving the VOC removal filter in the VOC removal performance, it has been common practice to increase the VOC removal filter in airtightness, by increasing the VOC removal filter in thickness, density, and/or the like.

However, increasing the VOC removal filter in airtightness, which is effective to improve the VOC removal filter in VOC removal performance, is problematic in that it exacerbates the increase in the internal temperature of the image forming apparatus, because it reduces the amount of the outward ventilation of the image forming apparatus.

Further, in order to remove ozone, which is generated by the electrical discharge from the charging member in the image forming apparatus, from being exhausted from the main assembly of an image forming apparatus, it is necessary for the air exhausting portion of the image forming apparatus to be fitted with a filter for removing ozone. This further restricts the air exhausting portion in gas permeability.

However, ozone is capable of functioning as an oxidizer. Therefore, the efficiency with which the VOCs are decomposed can be increased by the utilization of the ozone generated in an image forming apparatus.

SUMMARY OF THE INVENTION

The primary object of the present invention is to improve an apparatus, from which volatile organic components and ozone need to be removed, in the efficiency with which volatile organic components are decomposed and/or removed by a filter, without increasing the filter in gas (air) permeability.

According to an aspect of the present invention, there is provided an image forming apparatus for forming an image on a recording material, includes discharging means for effecting electric discharge for forming the image; an air path portion for guiding both of ozone produced by the electric discharge and volatile organic compounds produced in the image forming apparatus toward outside atmosphere; a first removing member, provided in the air path portion, for decomposing and removing the volatile organic compounds; a second removing member, provided in the air path portion, for removing the ozone, wherein the first removing member and the second removing member are disposed in the air passing portion in series, and the first removing member is disposed upstream of the second removing member with respect to a direction of flow in the air passing portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 2:
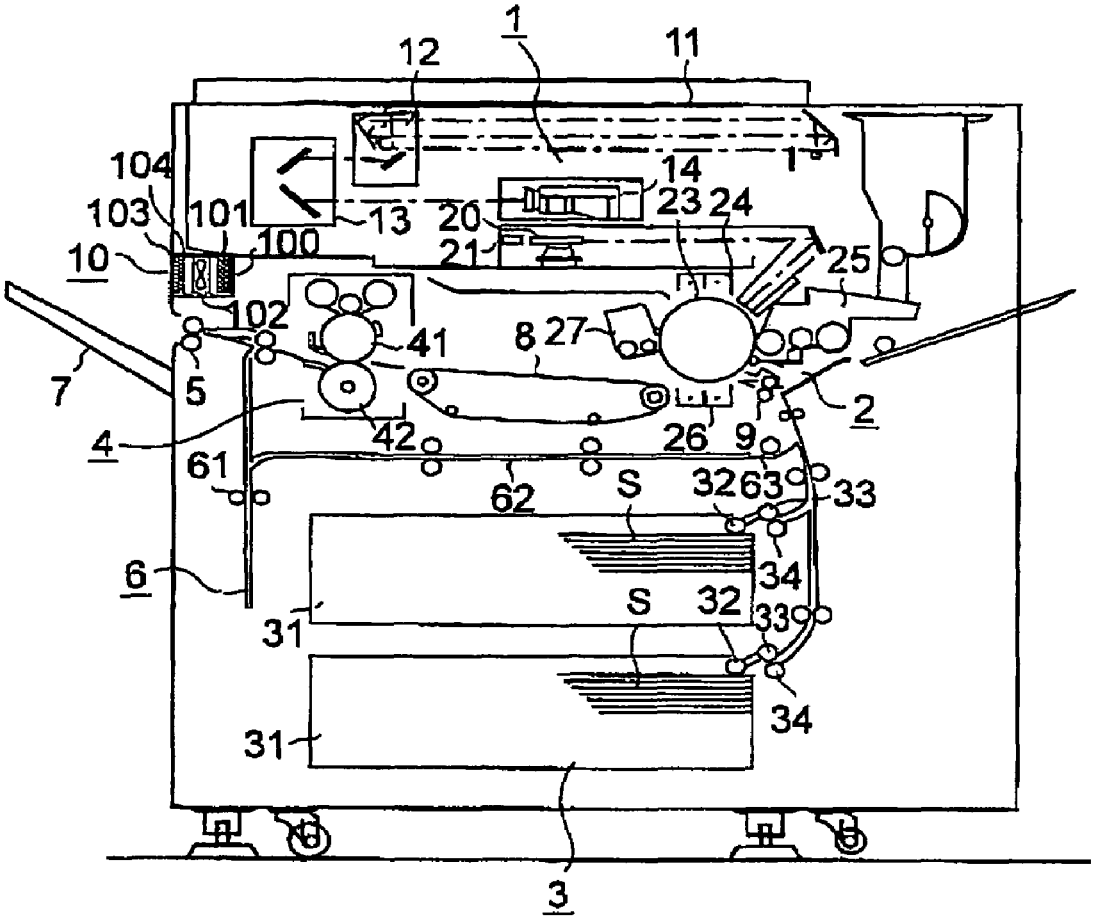
FIG. 2 is a schematic sectional view of the image forming apparatus in the first embodiment of the present invention.

First, referring to FIG. 2, a typical image forming apparatus to which the present invention is applicable will be described in detail.

(Reader Portion 1)

An unshown original placed on the original placement glass platen 11 of the reader portion 1 is illuminated by the scanning optical system 12 having a light source and a set of deflection mirrors. The light reflected by the original is focused on the CCD 14 through the reduction lens 13, being thereby converted into analog electric signals as image formation data. The analog electric signals are converted into digital electric signals, and are transferred to the memory which stores the image formation data.

(Image Formation Portion 2)

Next, the image formation portion 2 as an image forming means will be described. First, the photosensitive drum 23 as an image bearing member is uniformly charged to a predetermined potential level, which is 600 V in this embodiment, by the charging device 24, as a charging means, of the corona type, with electrical discharge occurring between the photosensitive drum 23 and charging device 24. Then, an electrostatic latent image is formed across the uniformly charged portion of the peripheral surface of the photosensitive drum 23, by the exposing apparatus as a means for forming an electrostatic latent image. The exposing apparatus has a laser light emitting portion 21, which is driven by a laser driver. The laser light emitting portion 21 emits a beam of laser light while modulating the beam of laser light with the image formation information obtained by the abovementioned reader portion 1. The beam of laser light is deflected by a polygon mirror 20 as a means for deflecting the beam of laser light, being thereby caused to scan the uniformly charged portion of the peripheral surface of the photosensitive drum 23 in the direction parallel with the generatrix of the photosensitive drum 23. As a result, an electrostatic latent image is formed across the portion of the peripheral surface of the photosensitive drum 23, which has been uniformly charged to the predetermined potential level by the charging device 24. In this embodiment, it is the numerous points of the uniformly charged area of the peripheral surface of the photosensitive drum 23, which correspond to the points to which developer (toner) is to be adhered, that are exposed, and the potential level of the exposed points is −150 V. The electrostatic latent image is developed by the developing device 25 as a developing means disposed in the adjacencies of the photosensitive drum 23 in order to develop an electrostatic latent image. In this embodiment, one of the developing methods which develop an electrostatic latent image in reverse is employed to develop the latent image. The development bias is set to −300 V, for example. The toner image, that is, a visual image obtained by developing the latent image by the developing device 25, is transferred onto a recording paper S by a transfer charging device 26 as a transferring means for transferring a toner image onto transfer medium such as an intermediary transferring member, ordinary transfer medium, etc. Incidentally, the toner remaining on the peripheral surface of the photosensitive drum 23 after the toner image transfer is removed by a cleaning device 27 as a cleaning means.

In this embodiment, a charging device of the corona type, which is a corona discharging means, is employed as the charging means. However, a charge roller may be employed in the place of the charging device of the corona type so that the image bearing member is charged through the electrical discharge between the charge roller and image bearing member. Also in this embodiment, a charging device of the corona type, which is a corona discharging means, is employed as the transferring means. However, a transfer roller may be employed in the place of the charging device of the corona type so that a toner image on the image bearing member is transferred onto transfer medium through electrical discharge.

(Conveying Portion 3)

In the bottom portion of the main assembly of the image forming apparatus, a paper feeding cassette 31, in which recording papers S are stored, is removably mounted. The recording papers S in the paper feeding cassette 31 are picked up by a pickup roller 32, and are conveyed, while being separated one by one, by the combination of a conveyance roller 33 and a return roller 34. Then, each recording paper S is corrected in attitude by the registering portion 19, and is conveyed to the aforementioned image formation portion 2.

(Fixing Portion 4)

The recording medium S (recording paper S), onto which a toner image has just been transferred in the image forming portion 2, is guided by a conveyance belt 8 into a fixing portion 4 as a fixing means, which comprises a fixation roller 41 and a pressure roller 42. The fixation roller 41 contains a halogen heater as a heat generating member, and comes into contact with the toner image on the recording medium S. The pressure roller 42 is kept pressed upon the fixation roller 41 to form a nip through which the recording medium S is conveyed while remaining pinched by the heat roller 41 and pressure roller 42. As the recording medium S is conveyed through the abovementioned nip, the unfixed toner image on the recording medium S is subjected to the heat and pressure applied by the heat roller 41 and pressure roller 42. As a result, the toner image is fixed to the recording medium S. The surface temperature of the fixation roller 41 is controlled by controlling the amount of the electrical current supplied to the halogen heater, in response to the output of a surface temperature detecting member such as a thermistor or the like, so that the surface temperature remains constant at a target level, which in this embodiment is 200° C.

As a coated paper or the like is heated by the fixing means, the VOCs in the resin of the coated paper or the like are likely to be released therefrom.

In the ordinary copying mode (single-sided copying mode), after the recording medium S is put through the fixation process, it is discharged from the main assembly of the image forming apparatus by a pair of discharge rollers 5, and is accumulated in the delivery tray 7.

(Recording Medium Turning Portion 6)

In the two-sided copying mode, after the recording medium S is put through the nip between the fixation roller 41 and pressure roller 42 of the fixing portion 4, it is conveyed by a pair of switchback rollers 61 so that not only is the leading edge of the recording medium S placed at the trailing end, but also, the top surface is placed on the bottom side. Thereafter, the recording medium S is conveyed to the registering portion 9 through the two-sided printing mode conveyance path 62, for the second image formation on the same recording medium S. Then, the recording medium S is discharged from the image forming apparatus after being subjected to the same image formation process as that to which the recording medium S is subjected when in the single-sided printing mode.

Figure 1:
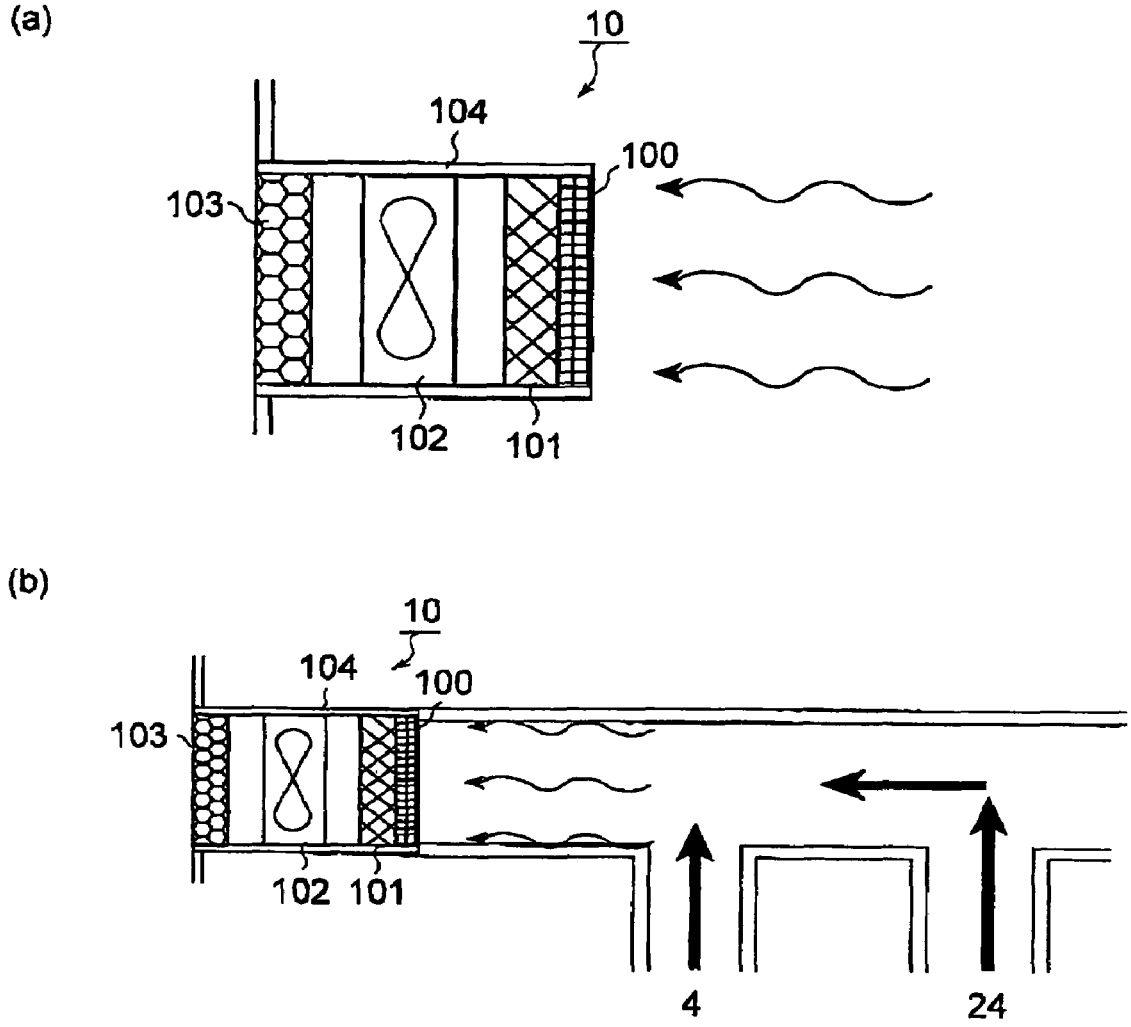
FIG. 1(*a*) is a schematic sectional view of the gas (air) exhausting portion of the image forming apparatus in the first embodiment of the present invention, and FIG. 1(*b*) is a schematic sectional view of one of the modifications of the air passage leading to the gas (air) exhausting portion of the image forming apparatus in the first embodiment of the present invention.

Next, referring to FIG. 1, the gas (air) exhausting portion 10 of an image forming apparatus, which is in accordance with the present invention, and constitutes a part of the air passage through which the air in the main assembly of the image forming apparatus is exhausted, will be described.

(Gas (Air) Exhausting Portion 10)

This image forming apparatus is provided with the gas exhausting portion 10 for exhausting the air (gas) in the main assembly of the image forming apparatus. The gas exhausting portion 10 comprises: a dust filter 100 as an ordinary air filtering member; a VOC removal filter 101 as a first special air filtering member, which is a filter of the catalyst type capable of oxidizing VOCs; a fan 102 as an air moving means (blower), for example, the combination of a 80 mm×80 mm square frame and a rotational fan fitted within the square frame; an ozone removal filter 103 as a second special air filtering member; and a duct 104 as the air passage leading to the external opening of the gas exhausting portion 10.

The abovementioned catalytic filter 101 for oxidizing VOCs comprises a substrate formed of woven or unwoven fabric, a thin plate, etc., and an oxidizing catalyst, for example, a precious metal such as platinum, palladium, etc., a base metal such as manganese, iron, etc., which is borne by the substrate. It is a filter capable of facilitating the process of oxidizing the VOCs to decompose it. Incidentally, it may be structured in a honeycomb fashion.

It should be specifically noted here that the filter, in accordance with the present invention, for removing the VOCs by oxidizing it, is quite different from a conventional ozone filter which decomposes ozone with the use of catalyst. The VOCs are chemically more stable than ozone. Therefore, the VOC removal filter must be substantially higher in the efficiency with which it decomposes or removes chemical components than a conventional ozone filter. In order to increase a gas (air) filter in the efficiency with which it decomposes or removes VOCs, it is desired that a filter is given not only the catalytic function, but also, the function of adsorbing the VOCs thereto. More specifically, a gas (air) filter having a catalytic layer, and an adsorptive layer formed of activated carbon or the like capable of adsorbing chemicals, a catalytic filter coated partially with an adsorptive substance, or the like filter, may be employed as the VOC removal filter. In other words, the VOC removal filter in accordance with the present invention is provided with a layer of activated carbon as well as a layer of catalyst so that the adsorbed VOCs are decomposed by the catalyst, making it thereby difficult for the VOCs to pass through the filter. Further, the filter may be rendered lower in gas (air) permeability than the conventional ozone filter; for example, it may be a filter with fine mesh that is structured in a honeycomb fashion, a filter having a thick catalytic layer, or the like. Reducing a filter in gas (air) permeability as described above increases the length of the time it takes for the VOCs to pass through the filter, providing more time for the VOCs to be decomposed.

As for the ozone filter 103, it is a filter of the adsorption type comprising a substrate formed of woven or unwoven fabric, thin plate, or the like, and activated carbon borne on the substrate. It may be structured in the honeycomb fashion.

Incidentally, the choice of the ozone removal filter does not need to be limited to the above described ones. That is, even if a filter of the adsorption type which simply adsorbs ozone, or a catalytic filter which removes ozone by decomposing it, is employed as the ozone filter 103, there will be no problem.

The air to be exhausted through the gas (air) exhausting portion 10 of the image forming apparatus in this embodiment contains scattered airborne toner particles, the ozone generated by the charging device 24 of the image formation portion 2, the VOCs released from the coated paper S by the heat from the fixing portion 4, etc. This air is guided to the gas (air) exhausting portion 10 by the fan 102, and therefore, the scattered airborne toner particles, ozone, VOCs, etc., in the air are all guided to the gas (air) exhausting portion 10. Thus, as the air is moved through the gas (air) exhausting portion 10, first, the scattered airborne toner particles and the like are removed as the air is moved through the dust filter 100, that is, the filter disposed most upstream in terms of the direction in which the air is exhausted.

After the removal of the scattered airborne toner particles and the like from the air, the air is moved through the catalytic filter 101 capable of oxidizing the VOC. This catalytic filter 101 is capable of oxidizing the VOCs, being therefore capable of removing, by decomposing, even such a VOC as formaldehyde that is relatively low in molecular weight. Moreover, at this stage of filtering, the air still contains the ozone generated by the charging device 24. The ozone is an oxidizing agent. Therefore, the VOCs are decomposed not only by the catalytic filter 101, but also, by this ozone. In other words, the ozone generated by the charging device 24 increases the efficiency with which the VOCs are decomposed.

Further, with the presence of the catalytic filter capable of oxidizing the VOCs in the gas (air) exhausting portion, it is possible to enhance the process of decomposing the VOCs. That is, the volatile organic components decompose by reacting with chemically active radicals, that is, chemical seeds, which are short in life span. For example, trichloroethylene decomposes by reacting with (being oxidized by) such radicals that are extremely powerful as oxidizing agents; it decomposes into carbon dioxide and chloride ions. The radicals which are extremely powerful as oxidizing agents are generated as the oxidizing agents such as ozone react with the catalyst. As will be evident from the above description, in this embodiment, not only does the ozone itself effectively oxidize the volatile organic components, but also, the filter itself comprises the catalyst. Therefore, the volatile organic components are more efficiently decomposed.

Also in this embodiment, the fan 102 as an air moving means is disposed downstream of the VOC oxidizing catalytic filter 101 in terms of the air exhausting direction. With the provision of this structural arrangement, the VOCs can be more efficiently moved through the VOC oxidating catalytic filter 101, preventing thereby the problem that some of the VOCs fail to be exhausted through the filter 102, accumulates in the image forming apparatus, and eventually leaks through the portions of the apparatus other than the filter 102.

Further, the VOC oxidizing filter 101 in this embodiment is a catalytic filter. Therefore, it is much longer in replacement interval than a VOC filter of the adsorption type, which removes the VOCs by adsorbing them, for the following reason. That is, as a VOC removal filter of the absorption type increases in the amount of the VOCs thereon, due to its adsorption of the VOCs, it reduces in its ability to adsorb the VOCs, and therefore, has to be frequently replaced. In comparison, a VOC removal filter of the catalytic type, which removes the VOCs by causing the VOCs to decompose, remains at the peak performance in terms of VOC removal, substantially longer than a VOC removal filter of the adsorption type.

Also in this embodiment, the ozone which the VOC oxidizing catalytic filter 101 fails to decompose is removed as it is moved through the ozone filter 103, that is, the last filter. Therefore, it is only clean air, that is, the air free of the scattered airborne toner particles, VOCs, ozone, etc., that is exhausted from the image forming apparatus.

Further, the image forming apparatus in this embodiment is structured so that both the ozone and VOCs are guided to the VOC oxidizing catalytic filter 101 without the provision of air passages (air ducts) dedicated to the guiding of the ozone and VOCs. However, an image forming apparatus may be structured as shown in FIG. 1(*b*). That is, it may be provided with a first air passage (air duct) dedicated to the guidance of the ozone from the charging device 24 to the air passage leading to the filter 101, and a second air passage (air duct) dedicated to the guidance of the VOCs from the fixing portion 4, or the source of the VOCs, to the air passage leading to the filter 101.

As described in the above description of the first embodiment of the present invention, according to the present invention, it is unnecessary to substantially reduce, in gas (air) permeability, the filter with which an apparatus, from which volatile organic components and ozone must be removed, is equipped in order to remove the volatile organic component and ozone therefrom.

Embodiment 2

Figure 3:
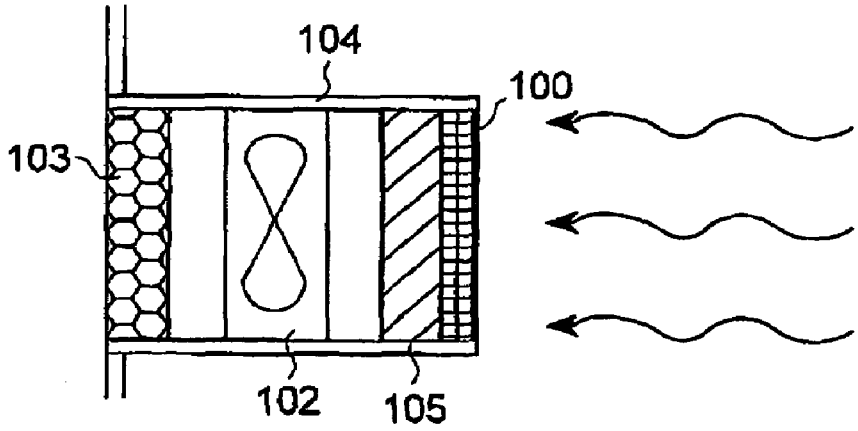
FIG. 3 is a schematic sectional view of the gas (air) exhausting portion of the image forming apparatus in the second embodiment of the present invention.

Next, referring to FIG. 3, the image forming apparatus provided with the gas (air) exhausting portion 10 in the second embodiment of the present invention will be described. The components shown in FIG. 3, which are identical to those in FIG. 1 are given the same referential symbols as those in FIG. 1, and will not be described here.

(Gas (Air) Exhausting Portion 10)

In this embodiment, the gas (air) exhausting portion 10 is equipped with a catalytic filter 105 which is different from the VOC oxidizing catalytic filter 101 in the preceding embodiment. This catalytic filter 105 is superior to the filter 101 not only in the ability to remove the VOCs by oxidizing them, but also, in the ability to utilize the ozone to oxidize the VOCs.

The catalytic filter 105 is made up of a substrate formed of woven or unwoven fabric, a thin plate, or the like, and ozone decomposing catalyst such as manganese oxide, nickel oxide, etc., borne on the substrate. However, it does not need to be made up as described above.

The air in the main assembly of the image forming apparatus is guided to the gas (air) exhausting portion 10 by a fan 102, and the scattered airborne toner particles are removed first as the gas (air) is moved through the dust filter 100, as in the first embodiment.

Then, as the air, from which the scattered airborne toner particles have just been removed is moved through the VOC decomposing catalytic filter 105, the ozone in the air, which was generated by the charging device 24, is decomposed into radicals, which oxidize the VOCs. The VOC decomposing catalytic filter 105 in this embodiment is rendered higher in the ability to remove the ozone by decomposing it, being therefore superior in the ability to generate of the radicals, to the VOC removal filter 101 in the first embodiment. Therefore, it is capable of decomposing even such VOCs as formaldehyde which are lower in molecular weight.

The portion of the body of the ozone or the like, which the catalytic filter 105 fails to decompose, is removed by the ozone filter 103. Thus, it is only clean air, that is, the air from which scattered airborne toner particles, VOCs, ozone, etc., have just been removed, that is exhausted from the main assembly of the image forming apparatus. The ozone filter 103 may be a filter of the adsorption type which adsorbs the ozone with its substrate, or a catalytic filter which decomposes the ozone.

Miscellaneous Embodiments

The present invention does not restrict the positioning of the above described dust filter 100, VOC oxidizing catalytic filter 101, fan 102, ozone filter 103, and duct 104, and the spaces in which they are placed. For example, they may be positioned, or shaped, as shown in FIGS. 4(*a*)-4(*c*).

Figure 4:
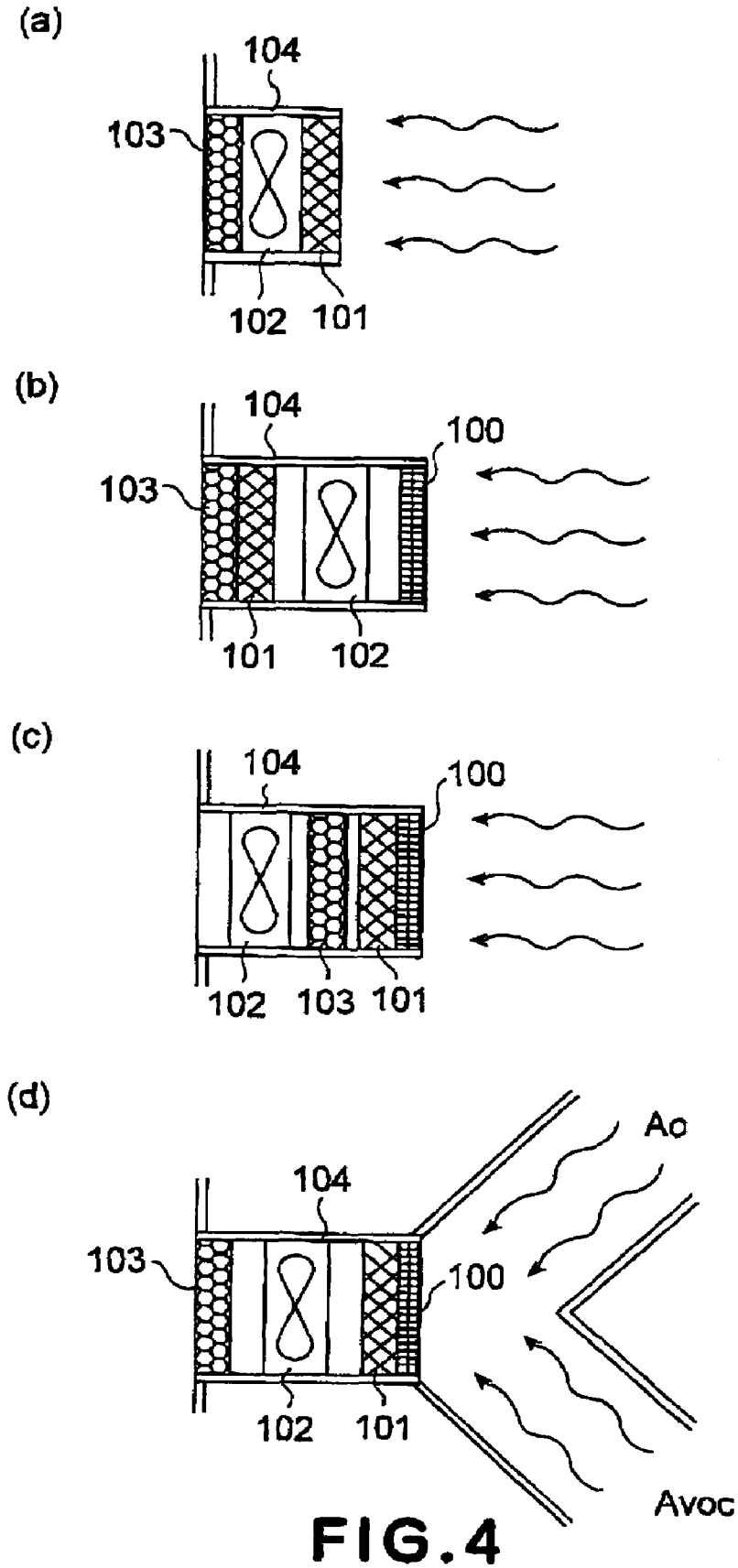
FIGS. 4(*a*)-4(*b*) are schematic sectional views of variations of the gas (air) exhausting portion in accordance with the present invention, FIG. 4(*a*) showing a gas (air) exhausting portion filter having no dust filter, FIG. 4(*b*) showing a gas (air) exhausting portion in which the fan is disposed upstream of the VOC removal filter in terms of the direction in which the internal air is exhausted, FIG. 4(*c*) showing a gas (air) exhausting portion in which the fan is disposed downstream of the ozone removal filter in terms of the direction in which the internal air is exhausted, and FIG. 4(*d*) showing a gas (air) exhausting portion provided with an air duct dedicated to guiding ozone to the air exhausting portion and an air duct dedicated to guiding AOCs to the air exhausting portion.

The gas (air) exhausting portion shown in FIG. 4(*a*) is not provided with the dust filter 100. Obviously, even this air exhausting portion shown in FIG. 4(*a*) can achieve the above described effects of the present invention.

FIG. 4(*b*) shows an example of an air exhausting portion, in which the VOC oxidizing catalytic filter 101 and ozone filter 103 are disposed next to each other, and the fan 102 is disposed upstream of the filters 101 and 103. This positional arrangement reduces the amount of the load which the fan 102 as an air moving means bears, and therefore, it can increase the amount of force with which the ozone and VOCs are suctioned away from within the image forming apparatus.

FIG. 4(*c*) shows an example of an air exhausting portion, in which the ozone filter 103 is disposed downstream of the fan 102 in terms of the air exhausting direction. This positional arrangement increases the amount of force by which the ozone and VOCs are suctioned by the fan 102, and therefore, it improves the efficiency with which the air is moved through the ozone filter 103 and VOC oxidizing filter 101, resulting in the improvement in the efficiency with which the air is exhausted from the image forming apparatus.

In the preceding embodiments, the image forming apparatuses were structured so that the ozone and VOCs are sent together into the air exhausting portion without the provision of air passages (air ducts) dedicated to guide the internal air of the image forming apparatus into the air exhausting portion. However, an image forming apparatus may be provided with an air duct dedicated to collecting the air Ao which contains the ozone from the image formation portion 2, and an air duct dedicated to collecting the air Avoc which contains the VOCs from the fixing portion 4, and the two air ducts are merged at the entrance of the air exhausting portion 10, so that individually collected air Ao and air Avoc are moved together through the VOC oxidizing catalytic filter 101 and ozone filter 103.

Also in the preceding embodiments, the VOC oxidizing catalytic filter 101 and ozone filter 103 were disposed in the portion of the air passages, which is near the air exhausting portion located next to the external wall of the image forming apparatus. However, the position of the two filters 101 and 103 does not need to be limited to the above described one. Rather, they may be disposed in the portion of the air passage, which is away from the air exhausting portion 10.

Further, the filter for removing the VOCs and ozone may be of the type in which the VOC removing catalytic portion and ozone removing portion are integrally disposed in this order in terms of the air exhausting direction. In other words, as long as the VOC oxidizing means is disposed upstream of the ozone removing means in terms of the air exhausting direction, the effects similar to those achieved by the air exhausting portions in the preceding embodiments can be achieved.

Even if an image forming apparatus is provided with a plurality of air exhausting portions, as long as the plurality of air exhausting portions are in accordance with the present invention, it is ensured that the VOCs and ozone are prevented from escaping from the main assembly of the image forming apparatus. Incidentally, in such a case, the number of the air exhausting portions in accordance with the present invention may be only one, and the other air exhausting portion(s) may be fitted with only the ozone filter, in order to reduce the cost of the main assembly of the image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 166674/2004 and 156808/2005 filed Jun. 4, 2004 and May 30, 2005 which are hereby incorporated by reference.

What is claimed is:

1. An image forming apparatus for forming an image on a recording material, comprising:

an image bearing member;

charging means for charging the image bearing member;

an air path portion for guiding both of ozone produced by charging the image bearing member and volatile organic compounds produced in said image forming apparatus toward outside atmosphere;

a catalyst filter provided in said air path portion;

an activated carbon filter provided in said air path portion;

wherein said catalyst filter and said activated carbon filter are disposed in said air path portion in series, and said catalyst filter is disposed upstream of said activated carbon filter with respect to a direction of flow in said air path portion.

2. An apparatus according to claim 1, further comprising a dust filter for removing dust, said dust filter being disposed upstream of said catalyst filter with respect to the direction of flow in said air path portion.

3. An apparatus according to claim 1, further comprising a first air path for guiding the ozone produced by said charging means toward said air path portion, and a second air path for guiding the volatile organic compounds from an inside of said image forming apparatus toward said air path portion, wherein said first air path and said second air path merge added to position upstream of said air path portion with respect to the direction of flow in said air path portion.

4. An apparatus according to claim 1, further comprising a fan, in said air path portion, for feeding the flow toward the outside of the of the apparatus.

5. An apparatus according to claim 4, wherein said fan is disposed at a position downstream of said catalyst filter with respect to the direction of flow in said air path portion.

6. An apparatus according to claim 1, further comprising heating means for the recording material, wherein air is guided from said heating means to said air path portion.

* * * * *

UNITED STATES PATENT AND TRADEMARK OFFICE

CERTIFICATE OF CORRECTION

PATENT NO. : 7,313,342 B2
APPLICATION NO. : 11/143706
DATED : December 25, 2007
INVENTOR(S) : Katayama et al.

It is certified that error appears in the above-identified patent and that said Letters Patent is hereby corrected as shown below:

COLUMN 2
Line 15, “includes” should read --including--.
Line 66, “AOCs” should read --VOCs--.

COLUMN 5:
Line 17, “a” should read --an--.

COLUMN 6:
Line 55, “accumulates,” should read --accumulate--.
Line 56, “leaks” should read --leak--.

COLUMN 7:
Line 27, “component” should read --components--.

COLUMN 10:
Line 3, “portion;” should read --portion; and--.
Line 20, “added to” should read --at a--.
Line 24, “of the” (second occurrence) should be deleted.

Signed and Sealed this

Twenty-sixth Day of August, 2008

JON W. DUDAS
*Director of the United States Patent and Trademark Office*